United States Patent [19]

Ochiai

[11] 4,330,907

[45] May 25, 1982

[54] VELVET TYPE FASTENER TAPE AND METHOD OF PRODUCING THE SAME

[75] Inventor: Koichi Ochiai, Tokyo, Japan

[73] Assignee: Yoshida Kogyo K.K., Tokyo, Japan

[21] Appl. No.: 135,672

[22] Filed: Mar. 31, 1980

[30] Foreign Application Priority Data

Apr. 5, 1979 [JP] Japan ..... 54-41472

[51] Int. Cl.[3] ..... A44B 17/00; D03D 27/00

[52] U.S. Cl. ..... 24/204; 139/391

[58] Field of Search ..... 24/204, 205.16 R, 201 R; 139/391

[56] References Cited

U.S. PATENT DOCUMENTS

| | | | |
|---|---|---|---|
| 2,717,437 | 9/1955 | Mestral | 24/204 X |
| 3,009,235 | 11/1961 | Mestral | 24/204 X |
| 3,114,951 | 12/1963 | Mestral | 24/204 |
| 3,469,289 | 9/1969 | Whitacre | 24/204 X |
| 3,562,770 | 2/1971 | Erb | 24/204 |
| 3,594,873 | 7/1971 | Hockmeyer, Jr. | 24/204 |
| 3,748,701 | 7/1973 | Mestral | 24/204 |
| 3,922,455 | 11/1975 | Brumlik | 24/204 X |
| 3,927,443 | 12/1975 | Brumlik | 24/204 |
| 3,943,981 | 3/1976 | De Brabande | 24/204 X |

*Primary Examiner*—Roy D. Frazier
*Assistant Examiner*—Peter A. Aschenbrenner
*Attorney, Agent, or Firm*—Bucknam and Archer

[57] ABSTRACT

A velvet type tape for use as closing means or fasteners for garments, curtains and the like. The fastener tape comprises a woven foundation structure, and a number of material-engaging elements carried on one side of the foundation structure. Each of the material-engaging elements is in the form of a loop raised from the foundation structure, the loop including a head section remote from the foundation structure and a pair of outwardly diverging leg sections. Each of the leg sections has on its outer side at least one material-hooking groove for receiving a loop on a companion fastener tape. A method of producing such a velvet type fastener tape is also disclosed.

7 Claims, 13 Drawing Figures

VELVET TYPE FASTENER TAPE AND METHOD OF PRODUCING THE SAME

BACKGROUND OF THE INVENTION

1. Field of the Invention

The present invention relates generally to closures or fasteners for garments, curtains and the like, and more particularly to a velvet type fastener tape capable of interlocking with a companion fastener tape. The invention also relates to a method of producing such a velvet type fastener tape.

2. Prior Art

U.S. Pat. No. 2,717,437 discloses a fastening device comprising two woven fabric tapes of the velvet type having a number of hooks raised therefrom. The hooks on one of the two tapes engage with those on the other, making the fastener tapes capable of interlocking with themselves. The hooks of the prior device are provided by forming loops on the individual tape with at least one of warp thread of synthetic resin material and thermally setting the loops formed on the tape, after which the loops are cut on one side of the tape so that each loop produces at least one pile thread having a hook-shaped end.

According to U.S. Pat. No. 3,009,235, a fastening device consists of a number of hooks on one of two companion carrier tapes and a number of loops on the other. The hooks of this prior art are formed in substantially the same manner as those of U.S. Pat. No. 2,717,437.

Another known fastening device utilizes a number of mushroom-shaped stems as loop-engaging elements. The mushroom-shaped stems are provided by forming loops on a carrier tape with at least one of warp thread of synthetic resin material and cutting the loops at the top, after which the individual pile threads are thermally treated at the cut ends so that each pile thread has a swelled end.

Thus, according to the prior art, the loop-cutting, which usually requires a complicated and thus expensive cutting machine, is essential to provide the hook-shaped or mushroom-shaped engaging elements, with or without thermal treatment. In addition, the loop-engaging elements of the conventional devices are liable to come out from the carrier tape because they are in the form of discrete pile threads.

SUMMARY OF THE INVENTION

A velvet type fastener tape of the present invention comprises a number of material-engaging elements on a foundation structure, each of the material-engaging elements being in the form of a loop raised from the foundation structure. The loop includes a pair of outwardly diverging leg sections each having on its outer side at least one material-hooking groove for receiving one of a number of loops carried on a companion fastener tape. In use, if the two companion tapes are pressed against each other, the loops on the last-named tape are trapped by the material-engaging loops, making the fastener tapes capable of interlocking with themselves reliably with maximum ease.

According to a method of the present invention, a plurality of material-engaging grooves are formed in and along each of a number of second warp threads at predetermined distances. Then, the auxiary warp threads, together with a plurality of first warp threads, are woven with a number of weft threads so as to form a number of loops of the second warp thread such that the material-engaging groove be disposed in the leg sections of the loops on the outside. This method does not require the loop-cutting, which is essential to the prior art.

It is therefore an object of the present invention to provide a velvet type fastener tape which is free from the coming-out of loop-engaging element.

Another object of the invention is to provide a closing means or fasteners for garments, curtains and the like, which enables a large number of reclosures.

Still another object of the invention is to provide a velvet type fastener tape which can be produced less costly.

A further object of the invention is to provide a method of producing such a velvet type fastener tape.

Many other advantages, features and additional objects of the present invention will become manifest to those versed in the art upon making reference to the detailed description and the accompanying drawings in which preferred embodiments incorporating the principles of the present invention are shown by way of illustrative example.

DETAILED DESCRIPTION OF PREFERRED EMBODIMENTS

Figure 1:
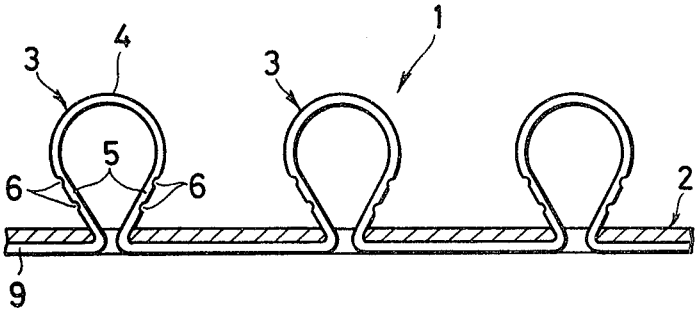
FIG. 1 is a schematic, longitudinal cross-sectional view of a fragment of a velvet type fastener tape according to a first embodiment of the present invention.

The principles of the present invention are particularly useful when embodied in a velvet type fastener tape (hereinafter referred to as 'fastener tape') such as shown in FIG. 1, generally indicated by the numeral 1.

The fastener tape 1 generally comprises a foundation structure 2 woven of weft and warp threads, and a number of material-engaging elements 3 carried on one side of the foundation structure 2. Each of the material-engaging elements 3 is in the form of a loop raised from the foundation structure 2, the loop including a head section 4 remote from the foundation structure 2 and a pair of outwardly (upwardly) diverging leg sections 5,5. Each of the leg section 5,5 has on the outer side at least one (two in the illustrated embodiment) material-hooking groove 6 for receiving a loop 7 carried on a companion fastener tape 8 as described below. The material-engaging elements 3 are formed of a thread 9 woven into the foundation structure 2 so as to have a number of the loops described above. The thread 9 is made of synthetic resin material, such as nylon or similar material, to give the material-engaging elements 3 a certain degree of flexibility and resiliency, thus enabling the preservation of the shape of the loops.

Figure 2:
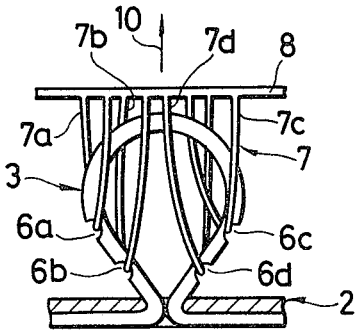
FIG. 2 is an enlarged cross-sectional view of the tape of FIG. 1, showing a material-engaging element as it is interengaged with loops on a companion tape.

FIG. 2 shows the fastener tape 1 carrying the material-engaging elements 3 (only one of which is shown here) and its companion tape 8 carrying a number of loops 7 (only four of which are shown here) to be hooked by the material-engaging elements 3, making the two fastener tapes 1,8 capable of interlocking with themselves. In use, if the two fastener tapes 1,8 are pressed against each other, the four loops *7a,7b,7c,7d* on the tape 8 are trapped by the hooking grooves *6a,6b,6c,6d* in the material-engaging element 3. At that time, the shorter loops *7a,7c* are received in the upper grooves *6a,6c*, respectively, and the longer loops *7b,7d* are received in the lower grooves *6b,6d*, respectively. With the loops 7 thus hooked by the grooves 6, the connection between the tapes 1,8 is retained against a pulling force in the direction of the arrow 10, i.e. perpendicularly of the tape 1,8.

Figure 3:
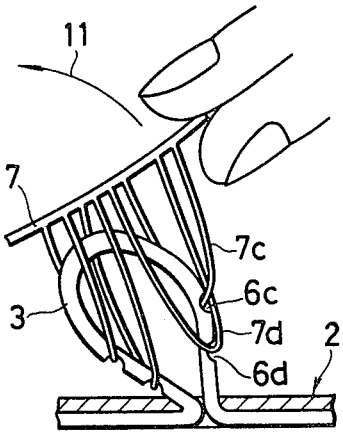
FIGS. 3 and 4 are views similar to FIG. 2, showing the manner in which the loops on the companion tape are released from the material-engaging element.
Figure 4:
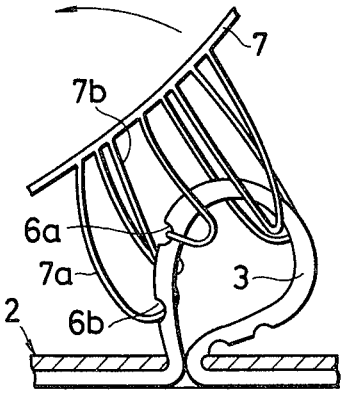

In order to separate the interlocked fastener tapes 1,8 apart, the tape 8 is gripped on its marginal portion by the fingers and then pulled in the direction of the arrow 11 (FIG. 3) as if peeling an orange. This causes the material-engaging element 3 to tilt leftwardly (as viewed in FIG. 3) so that the hooking loop (3) becomes flattened as shown in FIG. 3, allowing the loops *7c,7d* to release from the grooves *6c,6d* readily. With continued pulling of the tape 8 with the loops *7c,7b* thus released, the material-engaging element 3 swings back to the right (FIG. 4) for its own resiliency so that the remaining loops *7a,7b* can be released from the left side grooves *6a,6b*. Finally, the material-engaging element 3 resiliently returns from the position of FIG. 4 to the original position (FIG. 2), filliping the released loops *7a,7b* outwardly. This filliping action facilitates the separation of the two fastener tapes 1,8. Thus, the fastener tape 8 is detached from the fastener tape 1 completely.

As is well known in the art, the greater the number of the hooking member mates (i.e. material-engaging elements 3 and loops 7) per unit area, the more the possibilities of hooking are effected.

Figure 5:
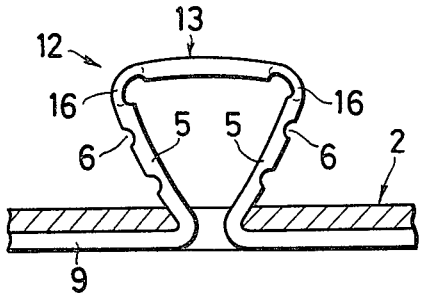
FIG. 5 is a schematic, longitudinal cross-sectional view of a fragment of a velvet type fastener tape according to a second embodiment.

According to a second embodiment of FIG. 5, a modified fastener tape 12 includes a number of material-engaging elements 13 the shape of which is triangular. With this arrangement, it is possible to offer a low-profile fastener with increased degree of inclination of loop legs 5,5, making the companion fastener tapes capable of interlocking with themselves more strongly.

Figure 6:
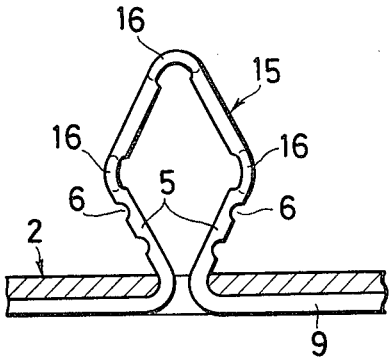
FIG. 6 is a view similar to FIG. 5 but showing a velvet type fastener tape according to a third embodiment.

According to a third embodiment of FIG. 6, a modified material-engaging element 15 has a quadrilateral shape with an acute angle at the top, allowing the loops on a companion fastener tape to reach the hooking grooves 6 smoothly.

Figure 7:
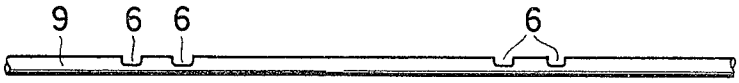
FIG. 7 is a fragmentary, enlarged side elevational view of a thread of synthetic resin material to be used in the first embodiment.
Figure 8:
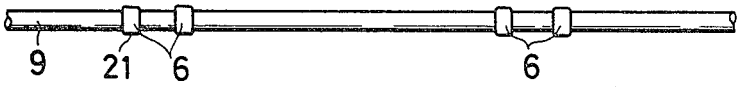
FIG. 8 is a plan view of the thread of FIG. 7.

To produce the material-engaging elements 3 of FIG. 1, a predetermined number of the material-hooking grooves 6 are formed in and along a thread 9 of synthetic resin material at predetermined distances as shown in FIGS. 7 and 8. For the modified material-engaging elements 13 (FIG. 5) or 15 (FIG. 6), a predetermined number of reduced-thickness portions 16 (FIGS. 9–12) in addition to the material-hooking grooves 6 are formed in and along one and the same thread 9 at appropriate distances.

Figure 13:
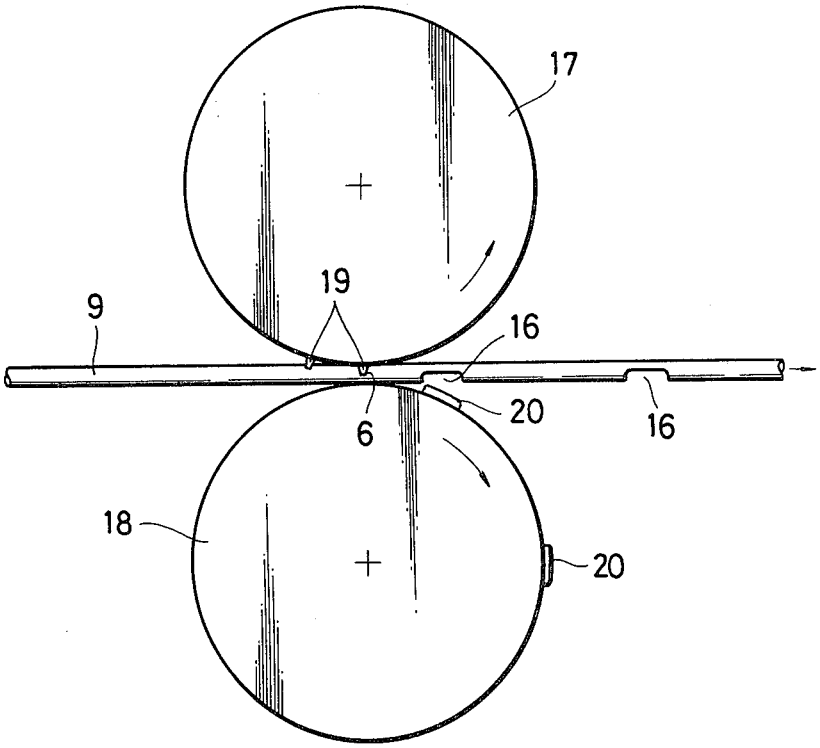
FIG. 13 is a schematic view illustrating the manner in which a thread of synthetic resin material is provided with a number of material-hooking grooves and a number of reduced-thickness portions in and along the thread.

The formation of the material-hooking grooves 6 and the reduced-thickness portions 16 may be made on an apparatus such as schematically shown in FIG. 13. The apparatus includes a pair of upper and lower forming rollers 17,18. The upper forming roller 17 has a pair of first projections 19 on its periphery, each first projection having the contour corresponding to the shape of the material-hooking groove 6 so that the thread 9 is provided with the material-hooking grooves 6 as the thread 9 is being advanced between the two rollers 17,18. The lower roller 18 has a pair of second projection 20 on its periphery, each second projection having such a contour that the reduced-thickness portions 16 are formed in the same manner as the material-hooking grooves 6. The second projections 20 on the lower roller 18 is of course unnecessary when the material-hooking elements 3 of FIG. 1 is to be produced. The thread 9 and the reduced-thickness portions 16 have lateral protuberances 21. The protuberances 21 also serve to hook the loops on a companion fastener tape, effecting an increased degree of resistance to separation of the two fastener tapes.

Then, using a suitable pile weaving machine (not shown), the thread 9 of FIGS. 7 and 8 is woven into the foundation structure 2 so as to form a number of loops raised from the foundation structure 2 such that the material-engaging grooves *6a,6b* and *6c,6d* be disposed in the leg sections 5,5 on the outside. As a result, the fastener tape 1 of FIG. 1 is produced in which each of the material-hooking elements 3 includes one of the loops formed by the thread 9.

Figure 9:
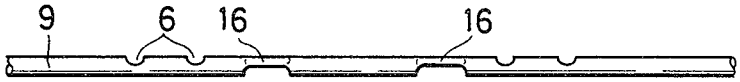
FIG. 9 is a side elevational view of a thread of synthetic resin material to be used in the second embodiment.
Figure 10:
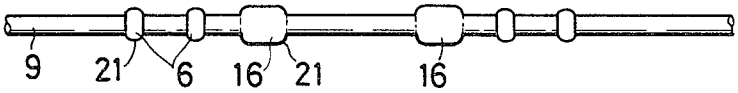
FIG. 10 is a plan view of the thread of the FIG. 9.
Figure 11:
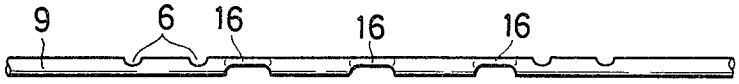
FIG. 11 is a side elevational view of a thread of synthetic resin material to be used in the third embodiment.
Figure 12:
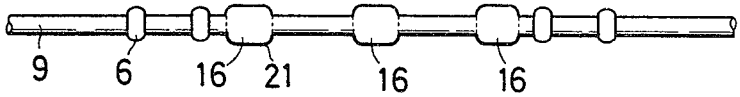
FIG. 12 is a plan view of the thread of FIG. 11.

Similarly, the thread 9 of FIGS. 9 and 10 (or FIGS. 11 and 12) is woven into the foundation structure 2 so as to form a number of loops raised in the foundation structure 2 such that the material-engaging grooves *6a,6b* and *6c,6d* be disposed in the leg sections 5,5 on the outside. And the weaving of the thread 9 is such that the loops formed by the thread 9 have bends at the reduced-thickness portions 16. The fastener tape of FIG. 5 (or FIG. 6) is thus produced.

Although various minor modifications may be suggested by those versed in the art, it should be understood that we wish to embody within the scope of the patent warranted hereon, all such embodiments as reasonably and properly come within the scope of my contribution to the art.

What is claimed is:

1. A velvet type fastener tape comprising:

(a) a foundation structure; and (b) a number of material-engaging elements carried on one of opposite surfaces of said foundation structure, each of said material-engaging elements being in the form of a loop raised from said foundation structure, said loop including a head section remote from said foundation structure and a pair of leg sections diverging outwardly of said foundation structure, each of said leg sections having on its outer side at least one material-hooking groove.

2. A velvet type fastener tape according to claim 1, said each material-engaging element being in the form of a triangular loop.

3. A velvet type fastener tape according to claim 1, said each material-engaging element being in the form of a quadrilateral loop.

4. A velvet type fastener tape according to claim 1, the loops of said material-engaging elements being formed with a synthetic resin thread.

5. A velvet type fastener arrangement comprising:

(a) a first tape including a first foundation structure and a number of first loops raised from one of opposite surfaces of said foundation structure; and (b) a second tape including a second foundation structure and a number of second loops raised from one of opposite surface of said second foundation structure, each of said second loops having a pair of outwardly diverging leg sections, each of said leg sections having on its outer side at least one loop-engaging groove for receiving one of the first loops on said first tape, whereby said first and second tapes, when pressed against each other, can be interlocked together.

6. A method of producing a velvet type fastener tape, comprising the steps of:

(a) providing a plurality of weft threads and a plurality of first and second warp threads, said second warp threads being made of synthetic resin material;

(b) forming a plurality of material-engaging grooves in and long each of said second warp threads at predetermined distances; and (c) weaving together said weft threads and said first warp threads and said second warp threads so as to form a number of loops of said second warp threads such that said material-engaging grooves be disposed in leg sections of said loops on the outside thereof.

7. A method according to claim 6, further including the step of forming a number of reduced thickness portions in and along said each second warp thread at predetermined distances, said weaving step being performed such that the loops of said each second warp thread have bends at the reduced thickness portions.

* * * * *